United States Patent [19]

Hein

[11] Patent Number: 4,695,297

[45] Date of Patent: Sep. 22, 1987

[54] ELECTROSTATIC PRECIPITATOR

[76] Inventor: Arthur G. Hein, 5274 Cliffridge Avenue, North Vancouver, British Columbia, Canada, V7R 3V4

[21] Appl. No.: 943,855

[22] Filed: Dec. 22, 1986

Related U.S. Application Data

[63] Continuation-in-part of Ser. No. 714,469, Mar. 26, 1985, abandoned.

[51] Int. Cl.[4] ..... B03C 3/36

[52] U.S. Cl. ..... 55/112; 55/128; 55/129

[58] Field of Search ..... 55/112, 128, 129

[56] References Cited

U.S. PATENT DOCUMENTS

| | | | |
|---|---|---|---|
| 1,344,330 | 6/1920 | Bradley | 55/129 |
| 1,953,082 | 4/1934 | Lawrence . | |
| 3,425,189 | 2/1969 | Haselmayer | 55/129 |
| 3,733,785 | 5/1973 | Gallaer | 55/129 |
| 3,831,350 | 8/1974 | Gilles et al. . | |
| 3,892,546 | 7/1975 | Grisell . | |
| 4,026,683 | 5/1977 | Snader et al. | 55/129 |
| 4,251,234 | 2/1981 | Chang | 55/129 |

FOREIGN PATENT DOCUMENTS

| | | | |
|---|---|---|---|
| 520710 | 2/1931 | Fed. Rep. of Germany | 55/129 |
| 598928 | 3/1948 | United Kingdom | 55/129 |

*Primary Examiner*—Tim Miles

*Attorney, Agent, or Firm*—Fetherstonhaugh & Co.

[57] ABSTRACT

A dry horizontal flow electrostatic precipitator for removing suspended particles from the gas flow. The precipitator has a casing, a treatment zone consisting of high voltage and collecting electrodes, rapping means to dislodge the particles from the electrodes, an inlet opening at one end of the casing for admitting the untreated gas and an outlet opening at the other end for discharging the treated gas stream. The precipitator has gas distribution means near the inlet face of the treatment zone to ensure non-uniform gas flow distribution so that more than one-half of the gas stream flows into the lower half of the treatment zone. In a further aspect there are gas distribution means at the outlet arranged to produce non-uniform gas flow distribution such that more than one-half of the gas stream flows out of the upper half of the treatment zone.

2 Claims, 5 Drawing Figures

ELECTROSTATIC PRECIPITATOR

CROSS REFERENCE TO RELATED APPLICATION

This application is a continuation-in-part of my copending application Ser. No. 714,469 filed Mar. 26, 1985, now abandoned, the disclosure of which is incorporated by reference.

FIELD OF THE INVENTION

This invention relates generally to dry horizontal flow electrostatic precipitators, and more particularly to the gas flow distribution at the precipitator inlet and outlet faces.

DESCRIPTION OF THE PRIOR ART

The use of electrostatic precipitators to remove suspended particles from gas streams is a well known art and dry horizontal flow precipitators are in service on many applications.

The treatment zone of a common dry horizontal flow precipitator consists of high voltage electrodes and collecting electrodes arranged to form gas passages parallel to the gas flow. The electrode systems are enclosed in a casing to contain the gas flow. Rapping systems are used to dislodge the dust from the electrodes which then falls by gravity to the bottom of the collector. The bottom of the casing is equipped with a dust removal system to discharge the collected dust.

The gas is supplied to the precipitator thru an inlet nozzle that connects the inlet duct to the precipitator casing. Gas flow distribution at the inlet has been recognized to affect precipitator performance and distribution devices are employed to spread the gas flow uniformly across the full face of the precipitator treatment zone. The details of the devices vary with the configuration of the inlet duct and nozzle, and with the preferences of the designer. The gas distribution devices are typically vanes in the inlet nozzle and diffuser plates at or near the inlet face.

Although flow distribution at the inlet has been the primary concern, distribution at the outlet has also been recognized to affect performance, and devices similar to those at the inlet are often used to control the outlet distribution.

Early precipitator installations were often designed with little regard to duct arrangement or gas flow distribution. U.S. Pat. No. 1,344,330 to Bradley issued in 1920 describes an unusual orifice-precipitator with electrode surfaces perpendicular to the flow, however it is the attention paid to gas distribution that is of interest. The inlet duct is connected to the precipitator casing without an inlet nozzle. The entire duct enters below the horizontal centerline of the casing, does not extend across the full width, and is offset from the vertical centerline of the casing. The opening to the treatment zone is into a small part of the treatment zone face and there are no flow distribution devices. The patent makes no mention of gas flow distribution. The collection efficiencies required during the early stages of precipitator development were achievable without addressing gas flow and the importance of flow distribution to performance had not yet been recognized.

The scientific investigation of the effects of flow distribution on electrostatic precipitator performance began about 1945 (H. J. WHITE, "Industrial Electrostatic Precipitation," Addison-Wesley Publishing Company, Inc. (1963) p. 238). This has resulted in progress towards the design of flow control means that will solve the fluid mechanics problem of taking the gas stream from the flow direction and flow velocity of inlet duct and delivering it to the inlet of the precipitator treatment zone with uniform distribution. Examples of this are U.S. Pat. Nos. 3,425,189 to Haselmayer and 3,831,350 to Gilles. Attention has also been given to achieving flow distribution with devices that are not adversely affected by dust deposits, for example U.S. Pat. No. 4,026,683 to Snader.

Optimum precipitator performance is associated with uniform gas flow, and uniform gas flow distribution at the precipitator inlet is the recommendation by precipitator manufacturers and other authorities on precipitators. The Industrial Gas Cleaning Institute (IGCI) first published a standard EP-7, Gas Flow Model Studies, in 1969. Since completely uniform gas distribution is not achievable, the IGCI standard for flow distribution gives tolerances on uniformity which are considered acceptable. Progressively higher efficiency requirements, the increasing awareness that gas distribution affects performance, improvements in measuring and control devices, and a mathematical analysis that shows uniform gas flow distribution gives best performance have led to raising the standards for flow uniformity. The revised standard for flow distribution issued by the IGCI in 1981 calls for a high degree of uniformity. Precipitator manufacturers try to achieve uniform flow and often perform model studies to help in the design of flow correcting devices.

The mathematical analysis on which the principle that uniform gas flow distribution gives best performance is based assumes uniform dust concentration over a section across the flow at any point within the precipitator. This assumption means either no re-entrainment takes place or that re-entrainment, if it does occur, does not change the dust concentration from the top to the bottom.

Re-entrainment changes the dust concentration from the top to the bottom of a dry horizontal flow precipitator. An electrostatic precipitator removes particles from a gas stream by charging them electrically and attracting them to an electrode. When a layer of dust has accumulated and a rapper is activated, the dust layer is dislodged and falls down due to the force of gravity. However, not all the dust reaches the bottom of the precipitator. The layer may begin to slide down as a sheet, but as it gathers speed, it breaks up and some of the dust is re-entrained on its way down. In a high efficiency precipitator most of the re-entrained dust is recollected further back and lower down within the treatment zone. The cycle of collection and re-entrainment may repeat itself several times before dust which entered the precipitator near the top falls below the bottom of the treatment zone and is truly collected. The cumulative effect of this re-entrainment increases the dust concentration in the lower zone of the precipitator compared with the upper zone as the flow travels thru the precipitator.

The action of gravity on uncollected particles passing thru the precipitator is also a factor that changes the dust concentration from the top to the bottom.

Observations made into the outlet nozzles of operating precipitators indicate that most of the losses occur towards the bottom of the outlet face.

This was recognized by Gallaer, U.S. Pat. No. 3,733,785. This patent recommends uniform inlet gas flow distribution and devices within the precipitator to direct the flow upward as it travels thru the unit to arrive at a skewed distribution at the outlet with the gas flow favoring the top. Precipitator performance depends on treatment time and this distribution slows down the flow in the lower zone toward the outlet giving more treatment time where the dust concentration is higher.

SUMMARY OF THE INVENTION

The present invention involves a significant departure from the accepted theory and practice of providing uniform gas flow at the inlet of a dry horizontal flow electrostatic precipitator.

A computer model was used to study how re-entrainment and gas flow distribution affect performance. The model is a two dimensional side view section of a precipitator from inlet to outlet and top to bottom with a vertical and a horizontal grid. Conditions across the width of the precipitator are assumed to be substantially constant. The grid breaks the precipitator treatment zone into a number of small elements. The same basic relationships that are commonly applied to predict the performance of large precipitators are used by the model to predict the performance of each element. Testing the model involves assigning a re-entrainment function which specifies how a dislodged dust layer is dispersed as it falls down. The performance with this re-entrainment function and with uniform gas flow distribution is determined as a reference. The inlet and outlet gas flow profiles are then adjusted to skewed distributions and the model is tested again to compute the performance which may then be compared with that for uniform flow.

The results show that a controlled non-uniform gas distribution may be used to improve the performance over uniform flow. Admitting more than half of the gas flow into the lower half and the remaining smaller proportion into the upper half of the inlet to the treatment zone and then discharging more than half the flow from the upper half and the remaining smaller proportion from the lower half of the outlet from the treatment zone is the preferred non-uniform gas distribution.

The computer model was tested using inlet and outlet skews that varied in a linear way from the top to the bottom. The shape of the skew for best performance may not be linear, and in practise will be rounded at the top and the bottom boundaries to avoid flow discontinuity.

With a gas flow distribution at the inlet different from the outlet, the flow profile changes within the precipitator and the four quarters of a precipitator side view operate generally as follows.

Upper Inlet—This section admits a small flow and a correspondingly small dust load. Because of the low velocity, the collection efficiency is high and relatively little dust leaves this section to enter the upper outlet. Losses due to re-entrainment of the dust falling from near the top are high, but apply to only a small amount of dust.

Upper Outlet—This section operates at high velocity and therefore low efficiency. Since the inlet load is small, the low efficiency and high rapping losses apply to only a very small fraction of the total dust.

Lower Inlet—This section admits a large flow and treats much more gas and receives correspondingly more dust than the section above it. The efficincy is lower because of the higher velocity but the total dust collected is more. The collected dust is nearer the bottom so the rapping losses are low. Considerable dust escapes to the lower outlet.

Lower Outlet—This section has a low velocity and therefore operates at high efficiency. The dust load from the lower inlet is collected efficiently near the bottom and is subject to low rapping losses.

BRIEF DESCRIPTION OF THE DRAWINGS

The drawings are all simplified illustrations of typical precipitators and gas distribution devices. In the drawings like parts are marked alike.

DESCRIPTION OF THE PREFERRED EMBODIMENTS

Figure 1:
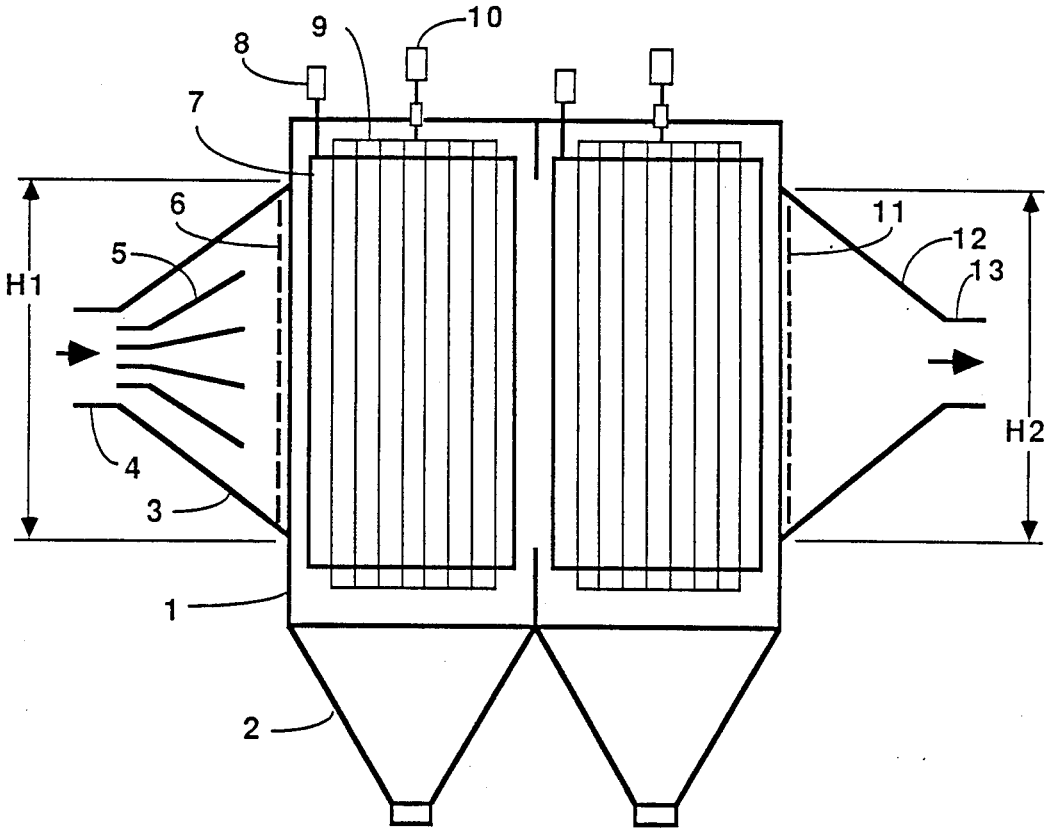
FIGURE 1 PRIOR ART
FIG. 1 is a side view cross section of a dry horizontal flow precipitator showing the major components.

FIG. 1 shows a cross-sectional side view of a dry horizontal flow precipitator. The casing 1 encloses the electrode systems. Collecting electrodes 7 are spaced to form gas passages parallel to the gas flow. High voltage electrodes 9 are spaced in the gas passages between the collecting electrodes and are supported from insulators. The zone formed by the gas passages in which the gas flow is exposed to the influence of the high voltage and collecting electrodes is the treatment zone. The treatment zone in this illustration consists of two electrode fields in the direction of gas flow. The number of fields in a precipitator may vary from a single field to a larger number. The bottom of the casing is equipped with a dust removal system, which may be a hopper system 2 as shown or another system such as drag conveyor or wet sluicing. Collected dust is dislodged from the electrodes by collecting electrode rappers 8 and high voltage electrode rappers 10 which may be external to the casing as shown, or inside the casing. These systems are all conventional.

Dust laden gas flows from an inlet duct 4 thru an inlet nozzle 3 to the inlet of the precipitator treatment zone. Turning vanes 5 and an inlet gas distribution device 6 are used to distribute the gas flow across the inlet face of the treatment zone. The inlet gas disribution device 6 may be a single diffuser place as shown, or several diffusers in series. The height of the opening into the treatment zone is given by dimension H1. The gas flows thru the treatment zone, an outlet distribution device 11, an outlet nozzle 12, and leaves thru an outlet duct 13. The height of the opening from the treatment zone is given by dimension H2.

Figure 2:
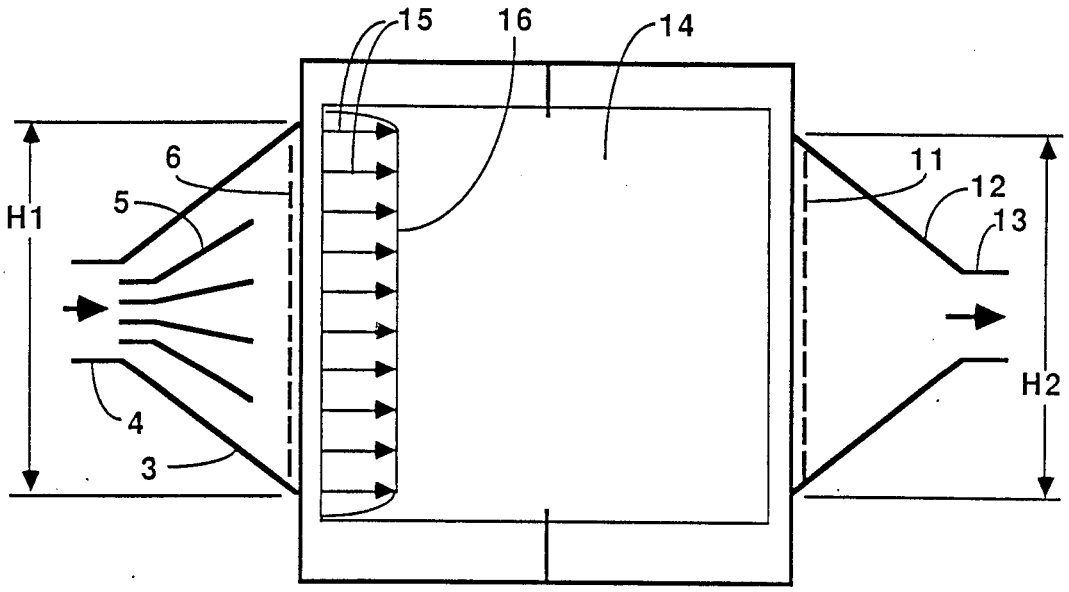
FIGURE 2 PRIOR ART
FIG. 2 is a side view showing an inlet gas distribution means designed to give uniform distribution according to prior art.

FIG. 2 shows ideal inlet gas flow distribution according to prior art. The inlet nozzle 3 is equipped with vanes 5 and distribution devices 6 designed to give uniform gas flow as the gas enters a treatment zone 14. The relative flow volume entering the treatment zone from top to bottom is depicted by the length of the arrows 15. For uniform gas flow distribution all the arrows are the same length resulting in a flow distribution profile 16 with half the flow entering the upper half, and half the flow entering the lower half of the height of the opening to the treatment zone.

Figure 3:
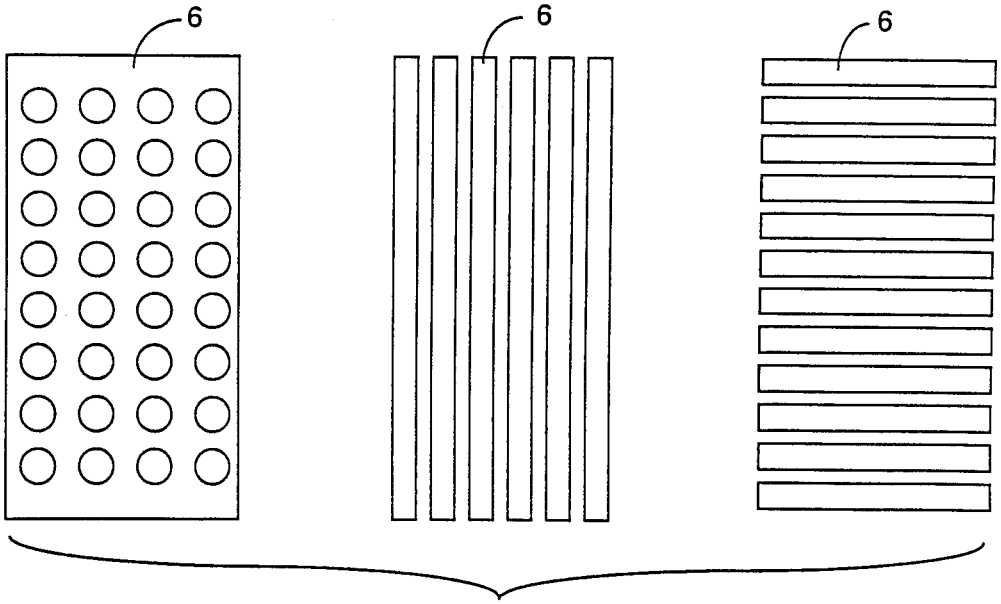
FIGURE 3 PRIOR ART
FIG. 3 is an end view of the inlet distribution device in FIG. 2 showing typical means designed to give uniform distribution according to prior art.

FIG. 3 shows typically the patterns of some distribution devices 6 that are designed to give uniform flow. They commonly have equal open area across the entire face.

Figure 4:
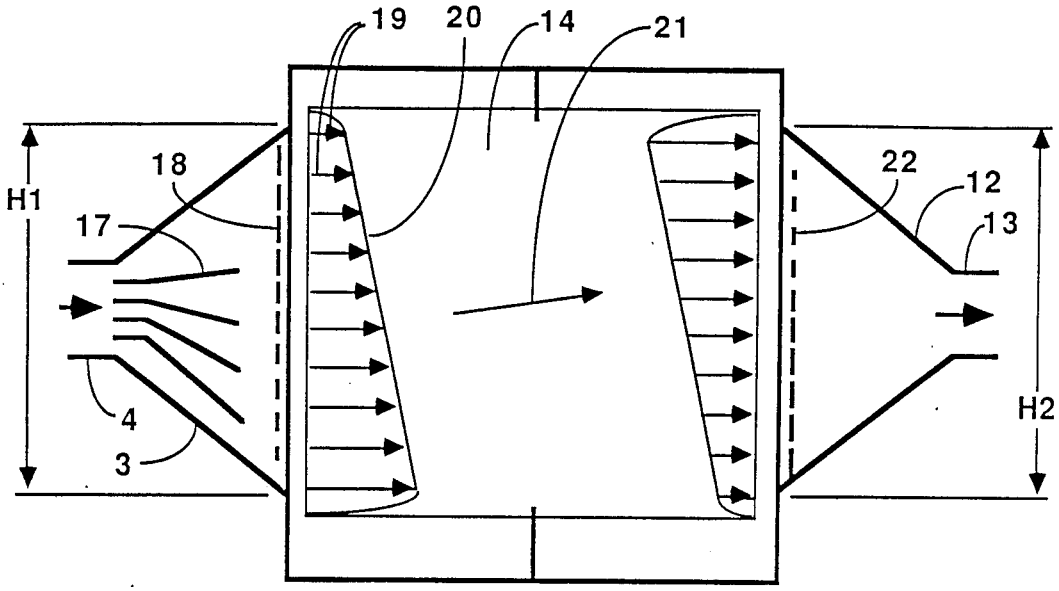
FIG. 4 is a side view showing an inlet gas distribution means designed to give non-uniform distribution according to a preferred embodiment of the invention.

FIG. 4 shows the preferred gas distribution according to the invention. The inlet nozzle 3 is equipped with vanes 17 and a distribution device 18 designed to spread the gas flow across the width and the height of the opening to the treatment zone to give a controlled non-uniform gas flow distribution as the gas flow enters the treatment zone 14. The relative flow volume entering the height of the opening to the treatment zone is depicted by the length of the arrows 19. The arrows are of unequal length. The longer arrows toward the bottom result in a gas distribution profile 20 such that more than half the total flow enters the lower half of the height of the opening to the treatment zone. The outlet gas distribution device 22 is designed in a reverse manner to the inlet device so that more than half the total flow leaves thru the upper half of the height of the opening from the treatment zone. This gas flow distribution results in a small upward component of flow as the gas flows thru the treatment zone as indicated by the slope of the arrow 21.

Figure 5:
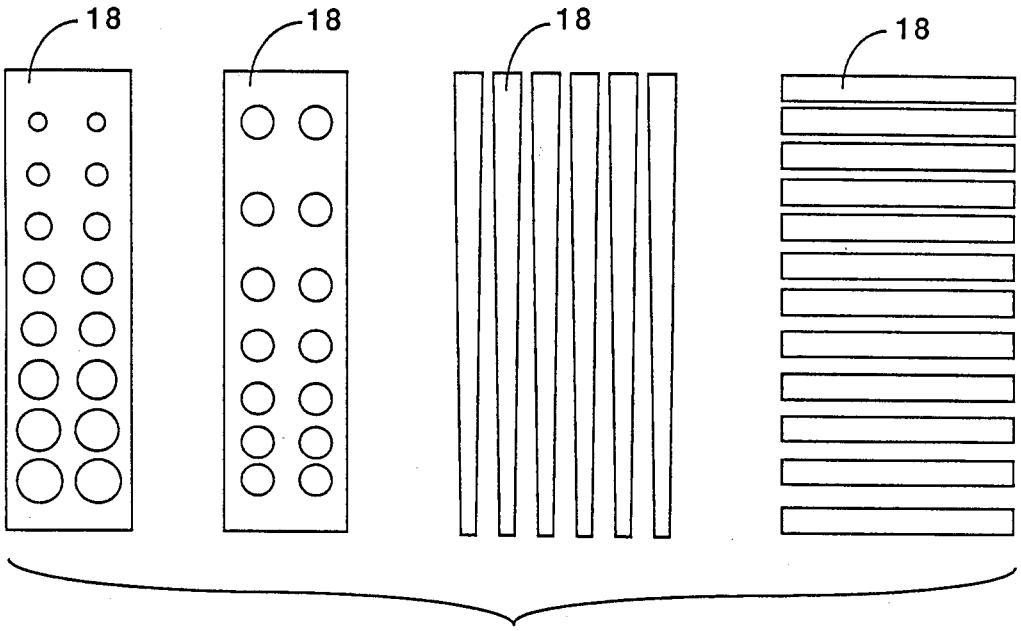
FIG. 5 is an end view of the inlet distribution device in FIG. 4 showing typical means designed to give the preferred distribution.

FIG. 5 shows typically the pattern of some distribution devices 18 designed to give the preferred non-uniform gas distribution at the inlet. A distribution device with more open area in the lower half than the upper half may be used to achieve the preferred gas distribution.

FIG. 1, FIG. 2, and FIG. 4 show horizontal flow inlet and outlet ducts with symmetric nozzles. Many other connecting duct and nozzle configurations are possible. In the manner that the design of the distribution devices required to give uniform flow is influenced by the configuration, so the design of the devices to give non-uniform flow will also be influenced by the configuration. Non-symmetricly shaped nozzles may be helpful in achieving the preferred non-uniform inlet and outlet gas distributions.

FIG. 3 and FIG. 5 show that the preferred gas distribution may be obtained by using vanes and distribution devices which except for the size or spacing of the openings are similar to those conventionally used to give uniform flow.

This invention is for the flow control means required to give controlled non-uniform gas distributions at the inlet and outlet faces of dry horizontal flow precipitators. The duct and nozzle configurations and the vanes and distribution devices at the inlet and outlet of the precipitator are the flow control means used to achieve a desired gas flow distribution. The details of the flow control means, whether they are of a type presently in use or of a type to be developed in the future, are not the issue of the invention. The issue is the use of these means to give the preferred non-uniform gas flow distribution.

I claim:

1. In a dry horizontal flow electrostatic precipitator for removing suspended particles from a gas stream, the precipitator having a casing, a treatment zone consisting of collecting and high voltage electrodes, rapping means to dislodge the collected dust, an inlet opening at one end of the treatment zone for admitting the untreated gas stream and an outlet opening at the other end of the treatment zone for discharging the treated gas stream, the improvement comprising gas flow control means at or near the inlet opening designed for non-uniform gas distribution, such that more than half the gas flow entering the treatment zone enters the lower half of the height of the opening to the treatment zone.

2. A precipitator as claimed in claim 1 further including gas flow control means at or near the outlet opening designed for non-uniform gas distribution such that more than half the gas flow leaving the treatment zone leaves the upper half of the height of the opening from the treatment zone.

* * * * *